US009911374B2

(12) United States Patent
Park et al.

(10) Patent No.: US 9,911,374 B2
(45) Date of Patent: Mar. 6, 2018

(54) DISPLAY DEVICE AND SELF-CALIBRATION METHOD FOR DIGITAL DATA DRIVEN SUBFRAMES

(71) Applicant: LG Display Co., Ltd., Seoul (KR)

(72) Inventors: Dongwon Park, Gyeonggi-do (KR); Yongchul Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/966,169

(22) Filed: Dec. 11, 2015

(65) Prior Publication Data

US 2016/0189620 A1 Jun. 30, 2016

(30) Foreign Application Priority Data

Dec. 26, 2014 (KR) ..... 10-2014-0190752

(51) Int. Cl.
*G09G 3/20* (2006.01)
*G09G 3/3225* (2016.01)
*G09G 3/3258* (2016.01)

(52) U.S. Cl.
CPC ..... *G09G 3/2022* (2013.01); *G09G 3/3225* (2013.01); *G09G 3/3258* (2013.01); *G09G 2300/0861* (2013.01); *G09G 2310/08* (2013.01); *G09G 2320/029* (2013.01); *G09G 2320/0233* (2013.01); *G09G 2320/0266* (2013.01); *G09G 2320/045* (2013.01);
(Continued)

(58) Field of Classification Search
CPC .. G09G 3/3258; G09G 3/3225; G09G 3/2022; G09G 2360/16; G09G 2330/021; G09G 2330/025; G09G 2310/08; G09G 2300/0861; G09G 2320/0233; G09G 2320/0266; G09G 2320/029; G09G 2320/0693; G09G 2320/045
See application file for complete search history.

(56) References Cited

U.S. PATENT DOCUMENTS 7,474,282 B2 * 1/2009 Okamoto ..... G09G 3/3233 345/76
2003/0122813 A1 7/2003 Ishizuki et al.
(Continued)

FOREIGN PATENT DOCUMENTS

JP 2011158821 A 8/2011

OTHER PUBLICATIONS

Communication dated Mar. 11, 2016 from the European Patent Office in counterpart European application No. 15200003.0.

*Primary Examiner* — Darlene M Ritchie
(74) *Attorney, Agent, or Firm* — Morgan, Lewis & Bockius LLP

(57) ABSTRACT

A display device is provided for dividing one frame period into a plurality of subframe periods, separating data of an input image on a per bit basis, mapping the data of the input image to the subframe periods, and representing gray levels of the input image. The display device includes a measurement unit configured to measure a current of a pixel; a luminance error calculation unit configured to calculate a rush current of the pixel emitting light at the measured current value, and to calculate a luminance error of the pixel based on the rush current; and a luminance error compensation unit configured to reduce an emission time of one of the subframe periods or remap the subframe periods to compensate for the luminance error.

15 Claims, 8 Drawing Sheets

(52) U.S. Cl.
CPC ..... *G09G 2320/0693* (2013.01); *G09G 2330/021* (2013.01); *G09G 2330/025* (2013.01); *G09G 2360/16* (2013.01)

(56) References Cited

U.S. PATENT DOCUMENTS

| | | | | |
|---|---|---|---|---|
| 2003/0137503 | A1* | 7/2003 | Kimura | H01L 27/3276 345/212 |
| 2003/0201727 | A1 | 10/2003 | Yamazaki et al. | |
| 2006/0238943 | A1* | 10/2006 | Awakura | G09G 3/3258 361/93.1 |
| 2009/0322724 | A1* | 12/2009 | Smith | G09G 3/2022 345/211 |
| 2010/0225675 | A1* | 9/2010 | Takahashi | G09G 3/3648 345/690 |
| 2011/0089853 | A1 | 4/2011 | Aurongzeb et al. | |
| 2012/0320005 | A1* | 12/2012 | Goden | G09G 3/2022 345/204 |
| 2013/0314456 | A1* | 11/2013 | Kim | G09G 3/2029 345/691 |
| 2015/0310808 | A1* | 10/2015 | Lee | G09G 3/20 345/690 |
| 2016/0372040 | A1* | 12/2016 | Huangfu | G09G 3/3258 |

* cited by examiner

| | SF1 | SF2 | SF3 | SF4 | SF5 |
|---|---|---|---|---|---|
| $16G(10000)_2$ | O | X | X | X | X |
| $15G(01111)_2$ | X | O | O | O | O |

DISPLAY DEVICE AND SELF-CALIBRATION METHOD FOR DIGITAL DATA DRIVEN SUBFRAMES

This application claims the benefit of Korean Patent Application No. 10-2014-0190752, filed on Dec. 26, 2014, the entire contents of which are incorporated herein by reference for all purposes as if fully set forth herein.

BACKGROUND OF THE INVENTION

Field of the Invention

Embodiments of the invention relate to a display device and, more particularly, to a display device having a self-calibration method thereof.

Discussion of the Related Art

Various flat panel displays, such as a liquid crystal display (LCD), an organic light emitting diode (OLED) display, a plasma display panel (PDP), and a field emission display (FED), have been used.

The liquid crystal display typically displays an image by controlling an electric field applied to liquid crystal molecules based on a data voltage. Within the field of LCDs, an active matrix liquid crystal display reduces the manufacturing cost and improves performance due to the development of process technology and driving technology. Hence, the active matrix liquid crystal display is applied to many display devices, from small-sized mobile devices to large-sized televisions, and has been widely used.

Because the OLED display is a self-emission display device, the OLED display may be manufactured to have lower power consumption and a thinner profile than the liquid crystal display, which requires a backlight unit. Further, because the OLED display has advantages of a wide viewing angle and a fast response time, the OLED display has expanded its market while competing with the liquid crystal display.

The OLED display is typically driven through a voltage driving method or a digital driving method, and may represent gray levels of an input image. The voltage driving method adjusts a data voltage applied to pixels depending on gray levels of data of the input image, and adjusts a luminance of the pixels depending on a magnitude of the data voltage, thereby representing the gray levels of the input image. Meanwhile, the digital driving method controls emission times of pixels depending on gray levels of data of the input image, and represents the gray levels of the input image.

Generally, the digital driving method time-divides one frame period into a plurality of subframe periods. Emission times of the subframe periods are set to be different from one another. In the digital driving method, the subframe periods are generally configured so that the emission time of the subframe period at each gray level linearly increases without considering on/off characteristics of the pixel. However, because the digital driving method neglects an undesired luminance appearing in the real on/off characteristics of the pixel, and simply sets the emission time of the subframe period in proportion to the gray level, a luminance error may be generated. Even a luminance reversal phenomenon between the gray levels may be generated. Because the luminance error or luminance reversal phenomenon may be differently generated in different display panels, they cannot be uniformly compensated for in the display panels.

SUMMARY OF THE INVENTION

Embodiments of the invention provide a display device and a self-calibration method thereof capable of compensating for a luminance error generated when pixels are turned on or off.

In one aspect, there is a display device for dividing one frame period into a plurality of subframe periods, separating data of an input image on a per bit basis, mapping the data of the input image to the subframe periods, and representing gray levels of the input image, the display device comprising a measurement unit configured to measure a current of a pixel in the display device; a luminance error calculation unit configured to receive a value of the measured current of the pixel from the measurement unit and to calculate a rush current of the pixel emitting light at the measured current value, and to calculate a luminance error of the pixel based on the rush current; and a luminance error compensation unit configured to receive the luminance error from the luminance error calculation unit and, based on the luminance error, to reduce an emission time of one of the subframe periods or remap the subframe periods to compensate for the luminance error.

In another aspect, there is a self-calibration method of a display device for dividing one frame period into a plurality of subframe periods, separating data of an input image on a per bit basis, mapping the data of the input image to the subframe periods, and representing gray levels of the input image, the self-calibration method comprising measuring a current of a pixel; calculating a rush current of the pixel emitting light at a value of the measured current of the pixel and calculating a luminance error of the pixel based on the rush current; and reducing an emission time of the subframe period or changing the turned-on subframe period to compensate the luminance error of the pixel.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Where possible, the same or similar reference numbers may be used throughout the drawings to refer to the same or like parts. Detailed description of known arts may be omitted if it is determined that the arts may mislead the embodiments of the invention.

Figure 1:
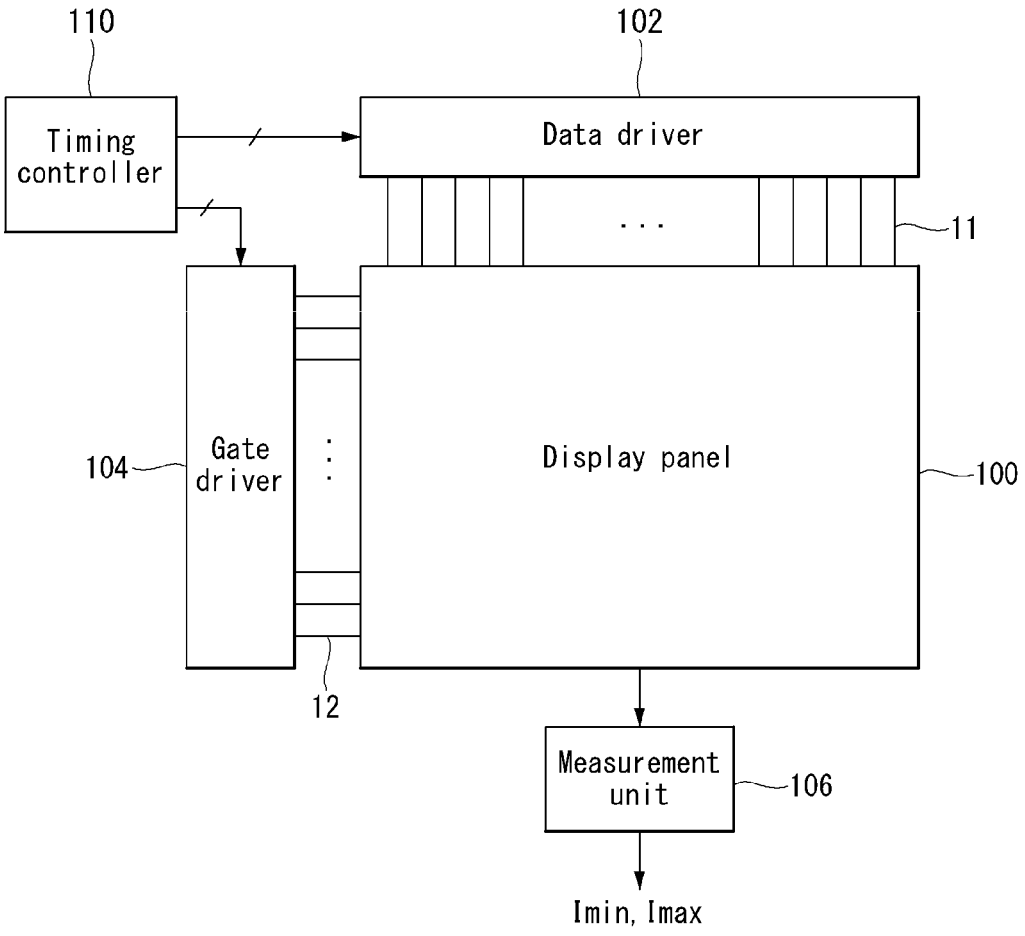
FIG. 1 is a block diagram of a display device according to an example embodiment of the invention.
Figure 2:
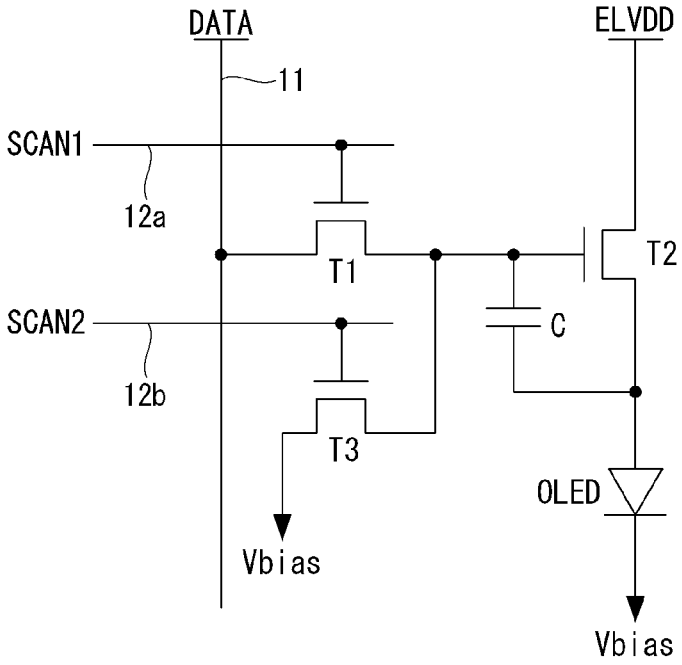
FIG. 2 is a circuit diagram of an example pixel of the display device shown in FIG. 1.

FIGS. 1 and 2 show a display device according to an example embodiment of the invention.

With reference to FIGS. 1 and 2, the display device according to an example embodiment of the invention includes a display panel 100, a display panel driver writing pixel data of an input image on a pixel array of the display panel 100 and including data driver 102 and gate driver 104, a measurement unit 106 measuring a current of a pixel, and a timing controller 110 controlling the display panel driver.

In the pixel array of the display panel 100, a plurality of data lines 11 and a plurality of scan lines (or gate lines) 12 cross each other. The pixel array of the display panel 100 includes pixels that are arranged in a matrix form and display an input image. Each pixel may include a red subpixel, a green subpixel, and a blue subpixel. Each pixel may further include a white subpixel. As shown in FIG. 2, each pixel may include a plurality of thin film transistors (TFTs), an organic light emitting diode (OLED), a capacitor, etc.

As noted above, in an example embodiment, the display panel driver includes a data driver 102 and a gate driver 104. The data driver 102 may convert data of the input image received from the timing controller 110 into a data voltage and output the data voltage to the data lines 11. In a digital driving method, amounts of light emitted by the pixels may be the same as one another, and gray levels of the data of the input image are therefore represented based on an emission time of the pixel. Therefore, the data driver 102 may select one of a voltage of a condition where the pixel emits light and a voltage of a condition where the pixel does not emit light, depending on a digital value of data mapped to a subframe, and may generate the selected data voltage.

The gate driver 104 sequentially supplies a scan pulse (or a gate pulse) synchronized with an output voltage of the data driver 102 to first scan lines 12*a* under the control of the timing controller 110. The gate driver 104 sequentially shifts the scan pulse and sequentially selects the pixels, to which data is applied, on a per line basis. The gate driver 104 sequentially supplies an erase pulse to second scan lines 12*b* under the control of the timing controller 110. The pixels may be configured such that they stop emitting light in response to the erase pulse. The timing controller 110 controls timing of the erase pulse and controls the emission time of the pixel in each subframe.

The measurement unit 106 measures a luminance or a current of the pixel using, for example, a light sensor or a current sensor, and transmits the result of the measurement to the timing controller 110. In an example embodiment disclosed herein, the pixel, of which the luminance or the current is measured, may be a pixel of the pixel array, on which the input image is reproduced, or a dummy pixel disposed in a non-display area of the display panel 100.

The timing controller 110 may receive the pixel data of the input image and timing signals synchronized with the pixel data of the input image from a host system (not shown). The timing controller 110 controls operation timings of the data driver 102 and the gate driver 104 based on the timing signals input in synchronization with the pixel data of the input image, and synchronizes the data driver 102 with the gate driver 104. The timing signals may include a vertical sync signal Vsync, a horizontal sync signal Hsync, a data enable signal DE, and the like.

Figures 5, 6:
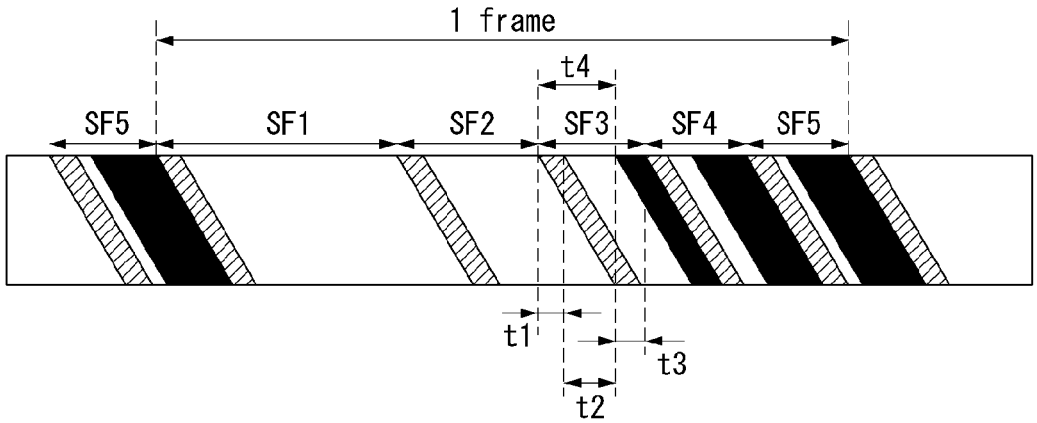
FIG. 5 shows an example of a method for arranging subframes.
FIG. 6 shows an example method for mapping data to subframes in a subframe arrangement method as shown in FIG. 5.

The timing controller 110 controls the display panel driver through the digital driving method. The timing controller 110 divides one frame period into a plurality of subframe periods. As shown in FIG. 5, emission times of subframe periods may be set to be different from one another depending on the data bit of the input image. In an example where the most significant bit (MSB) represents a high gray level, the MSB is mapped to a subframe having a long emission time. In an example where the least significant bit (LSB) represents a low gray level, the LSB is mapped to a subframe having a short emission time. The timing controller 110 maps data of the input image to the subframe on a per bit basis and transmits the mapped data to the data driver 102.

Figure 3:
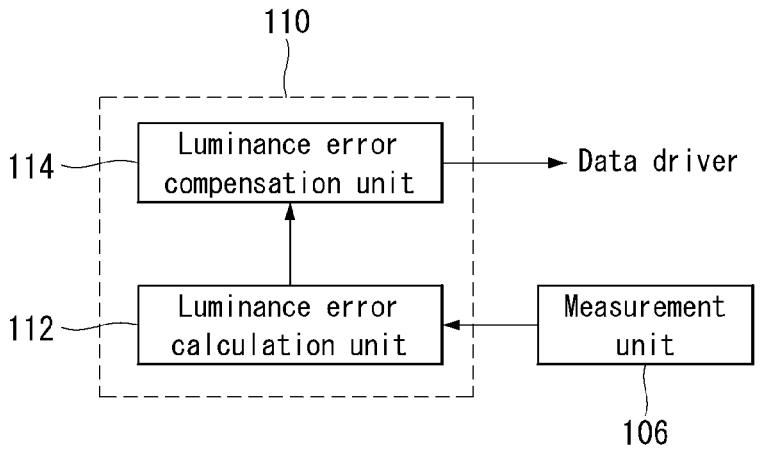
FIG. 3 shows a measurement unit, a luminance error calculation unit, and a luminance error compensation unit according to an example embodiment of the invention.

The timing controller 110 may include a self-calibration device, an example of which is shown in FIG. 3. The timing controller 110 calculates a luminance error of the pixel between gray levels using the self-calibration device based on a measured current value or a measured luminance value received from the measurement unit 106. The timing controller 110 adjusts the emission time of the subframe or performs the remapping of the subframes, thereby compensating for the luminance error.

The host system may be implemented as, for example, a television system, a set-top box, a navigation system, a DVD player, a Blu-ray player, a personal computer (PC), a home theater system, or a phone system.

As shown in the example of FIG. 2, each pixel includes a first TFT T1, a second TFT T2, a third TFT T3, an OLED, a storage capacitor C, etc.

The first TFT T1 is turned on in response to the scan pulse from the first scan line 12*a*. The first TFT T1 is a switching element supplying the data voltage DATA to a gate of the second TFT T2 in response to the scan pulse.

The second TFT T2 is connected between a power line, to which a high potential power voltage ELVDD is supplied, and the OLED (e.g., the anode of the OLED), and supplies the current to the OLED depending on the data voltage DATA applied to the gate of the second TFT T2. The second TFT T2 is a driving element that makes the OLED emit light depending on the data voltage DATA.

The third TFT T3 is turned on in response to the erase pulse from the second scan line 12*b* and discharges a gate voltage of the second TFT T2 down to a predetermined bias voltage Vbias. The bias voltage Vbias may be a low potential power voltage VSS. The third TFT T3 is a switching element forming a gate discharge path of the second TFT T2 in response to the erase pulse.

The storage capacitor C holds a gate-to-source voltage Vgs of the second TFT T2. The storage capacitor C holds the gate voltage of the second TFT T2 and maintains the emission of the OLED.

The OLED may be configured so that organic compound layers including, e.g., a hole injection layer HIL, a hole transport layer HTL, an emission layer EML, an electron transport layer ETL, an electron injection layer EIL, etc., are stacked. The OLED emits light when electrons and holes are combined in the emission layer EML.

Each pixel of the display panel 100 may be configured as shown in FIG. 2, but embodiments of the invention are not limited thereto. Each pixel may have any circuit configuration capable of being driven through the digital driving method. Each pixel may further include an internal compensation circuit. The internal compensation circuit includes at least one switching TFT and at least one capacitor. The internal compensation circuit initializes a gate of a driving TFT, senses a threshold voltage and a mobility of the driving TFT, and compensates for the data voltage DATA. The internal compensation circuit may use any known compensation circuit.

Figure 4:
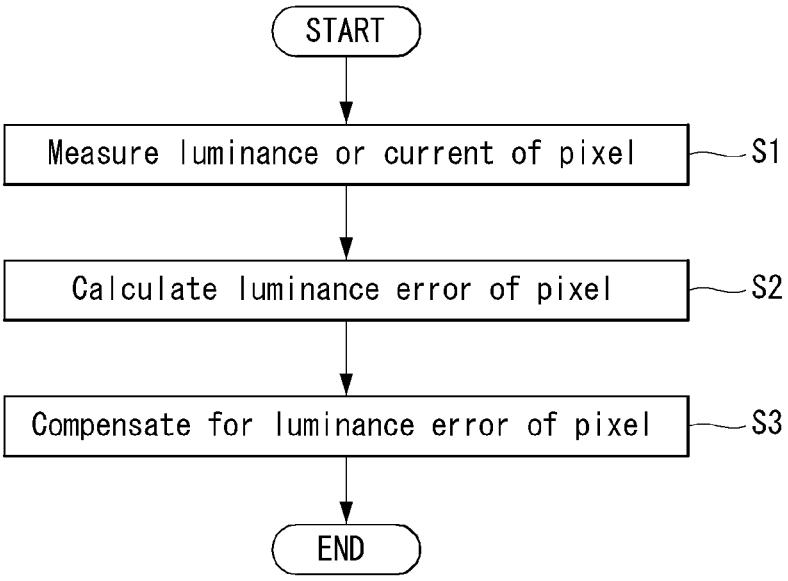
FIG. 4 is a flowchart showing a self-calibration method of a display device according to an example embodiment of the invention.

FIG. 3 shows the self-calibration device according to an example embodiment of the invention. FIG. 4 is a flowchart showing a self-calibration method of the display device according to the embodiment of the invention.

With reference to FIGS. 3 and 4, the self-calibration device according to this example embodiment of the invention includes the measurement unit 106, a luminance error calculation unit 112, and a luminance error compensation unit 114. The self-calibration device may be embedded in the timing controller 110, but embodiments of the invention are not limited thereto. For example, the self-calibration device may be implemented as a circuit configuration that is separate from the timing controller 110.

The example self-calibration method includes a step S1 of measuring a luminance or a current of the pixel, a step S2 of calculating a luminance error of the pixel, and a step S3 of compensating for the luminance error of the pixel.

The luminance error calculation unit 112 analyzes the result of the luminance or current measurement received from the measurement unit 106 and calculates a luminance error of the pixel at each gray level. A cause of the luminance error will be described with reference to FIG. 7, and a method of calculating the luminance error will be described with reference to FIG. 10.

Figure 12:
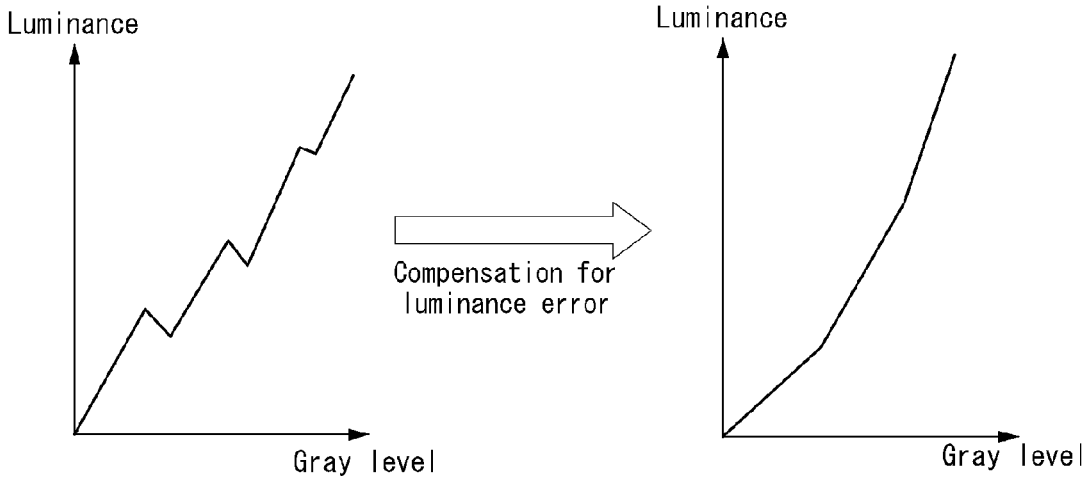
FIG. 12 shows an example result of compensation for a luminance error using a self-calibration method according to an example embodiment of the invention.

The luminance error compensation unit 114 receives the result of the calculation of the luminance error from the luminance error calculation unit 112. The luminance error compensation unit 114 adjusts an emission time of a subframe, to which the LSB of data is mapped, or performs the remapping of the subframes, thereby compensating for the luminance error. As a result, as shown in FIG. 12, a luminance of the pixel linearly or nonlinearly increases as the gray level increases.

The self-calibration device and the self-calibration method according to an example embodiment of the invention may be performed in a driving time previously set in the display device. For example, the self-calibration device and the self-calibration method may be performed in a power-on sequence immediately after the display device is powered on, and/or in a power-off sequence immediately after the display device is powered off. Further, the self-calibration device and the self-calibration method according to an example embodiment of the invention may measure the luminance or the current of the pixel in a vertical blank period, e.g., between two successively arranged frames in which data is not input, and may measure the luminance or the current of the pixel at previously set time intervals.

Because the display device according to example embodiments of the invention compensates for a luminance error resulting from a rush current based on the result of a measurement of a luminance or a current of a pixel in each of display panels using, for example, the self-calibration device and the self-calibration method shown in FIGS. 3 and 4, embodiments of the invention may adaptively compensate for the luminance error suitably for each display panel.

FIG. 5 shows an example of a method for arranging subframes. FIG. 6 shows an example method for mapping data to subframes in the subframe arrangement method shown in FIG. 5.

With reference to FIGS. 5 and 6, one frame period may be divided into first to fifth subframes SF1 to SF5. Each subframe may be subdivided into an address time t1 in which data is written on the pixels, an emission time t2 in which the pixels emit light, and an erase time t3 in which the pixels are turned off. The address time t1 for one line of the display panel 100 is one horizontal period. In one subframe (for example, the third subframe SF3), an address time t4, in which data is written on all of the lines of the display panel 100, is one vertical period. The timing controller 110 supplies the timing control signals to the data driver 102 and the gate driver 104 and controls timings of the address time t1, the emission time t2, and the erase time t3 of the subframe. In the example shown in FIG. 5, a length of the emission time t2 decreases to one half with the passage of time from the first subframe SF1 to the fifth subframe SF5. The erase time t3 is not assigned to the first and second subframes SF1 and SF2.

The first subframe SF1 includes an emission time representing a gray level of $2^4$ bits of data, and the second subframe SF2 includes an emission time representing a gray level of $2^3$ bits of data. The third subframe SF3 includes an emission time representing a gray level of $2^2$ bits of data, and the fourth subframe SF4 includes an emission time representing a gray level of $2^1$ bits of data. The fifth subframe SF5 includes an emission time representing a gray level of $2^0$ bits of data. 24-bit MSB of data is mapped to the first subframe SF1, and 4-bit ($2^3$ $2^2$ $2^1$ $2^0$) LSB of the data is mapped to the second to fifth subframes SF2 to SF5.

In the digital driving method, the data of the input image is mapped to the subframe on a per bit basis. The pixel is turned on or off depending on the gray level of the data on a per subframe basis. For example, when the gray level of the data is $16G(10000)_2$, the pixels are turned on and emit light in the first subframe SF1, and the pixels are turned off in the remaining second to fifth subframes SF2 to SF5. Further, when the gray level of the data is $15G(01111)_2$, the pixels do not emit light in the first subframe SF1, and the pixels emit light in the remaining second to fifth subframes SF2 to SF5. In FIG. 6, '○' indicates subframes in which the pixels emit light, and 'x' indicates subframes in which the pixels do not emit light.

The method of FIG. 5 is an example, and methods for arranging the subframes are not limited thereto. For example, the number of subframes assigned to one frame period or the emission time of the subframe may be variously changed.

The method for arranging the subframes according to an example embodiment of the invention adjusts the emission time of the subframes or performs the remapping of the subframes depending on the application of the self-calibration method.

Figure 7:
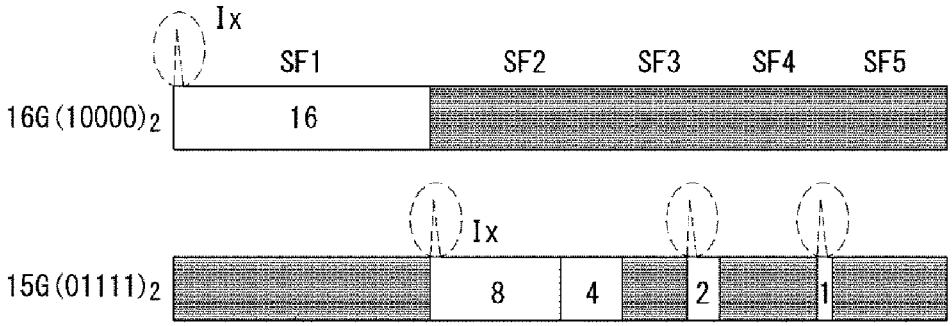
FIG. 7 shows an example where a luminance error of a pixel occurs due to a rush current of the pixel.

FIG. 7 shows an example where a luminance error of a pixel occurs due to a rush current of the pixel. In a digital driving method of a display, a plurality of subframes are assigned to one frame period, and a large number of switching operations (or a large number of transitions) of the pixel are generated in one frame period. When the pixel is converted from an off-state to an on-state, a rush current may occur in the pixel. The rush current is a current instantaneously and strongly generated when the pixel in the off-state is turned on. Because the rush current is instantaneously and strongly generated in the initial stage of the subframe, the rush current may lead to a luminance error of the pixel. In FIG. 7, "Ix" indicates the rush current of the pixel. The rush current instantaneously increases a luminance of the pixel to a value greater than the luminance represented by a gray level, leading to the luminance error or a luminance reversal between gray levels. The luminance reversal between the gray levels is a phenomenon in which a luminance that a low gray level represents is higher than a luminance that a high gray level represents. The digital driving method of an organic light emitting diode (OLED) display has many advantages, but solving this luminance error or luminance reversal problem resulting from the rush current of the pixel may further improve image quality of the OLED display.

In an example voltage driving method of the OLED display, there is no switching operation of the pixel in one frame period, and the current of the pixel is uniform. Therefore, any luminance error resulting from the rush current is, at most, scarcely generated. In a plasma display panel (PDP), gray levels are represented through the digital driving method. However, because the pixel is maintained in a plasma state after an address discharge writing data on the pixel and before a sustain period, the rush current is not generated in the pixel. Accordingly, because rush current of the pixel in the voltage driving method of the OLED display and the digital driving method of the PDP scarcely affects the image quality, problems of rush current may be ignored in such devices.

Figure 8:
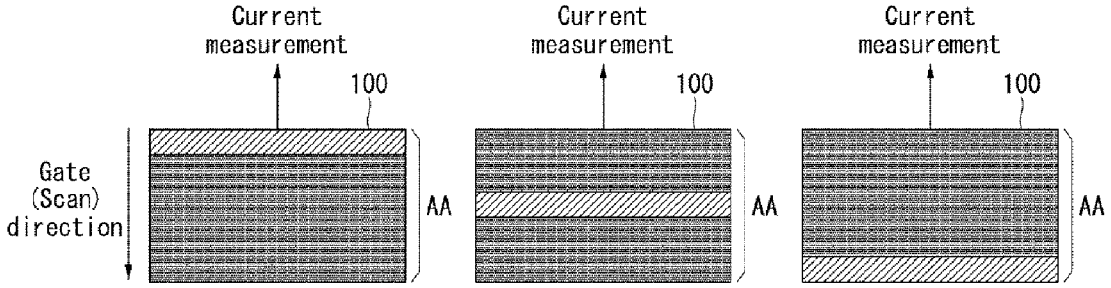
FIGS. 8 and 9 show an example method for measuring a current of a pixel.

Because the current flowing in the OLED of the pixel is proportional to the luminance of the pixel, the luminance error may be calculated by measuring the current of the pixel. Because there is a difference between driving characteristics of the display panels, the measurement unit 106 measures a current of a pixel generated by actually driving pixels (or dummy pixels). As shown in FIG. 8, the example measurement unit 106 may supply the gate pulse to at least one of gate lines of a pixel array AA, on which an image is displayed, and may supply the data voltage to the pixel through the digital driving method, thereby measuring a current of one or more pixels. As another example, the measurement unit 106 may measure the current through average values of several lines of the entire screen.

Figure 9:
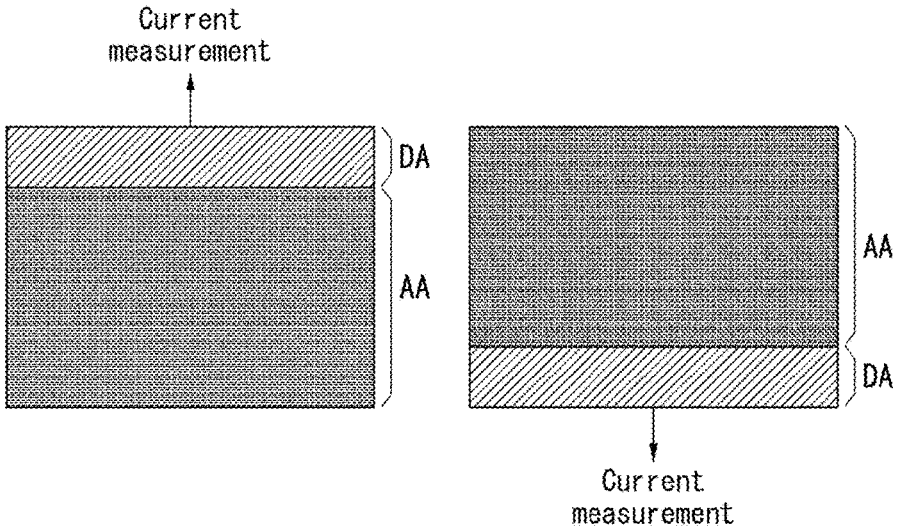

The measurement unit 106 may measure the current from a dummy pixel positioned in a non-display area so that the screen is not turned on. In an example embodiment of the dummy pixel, a structure of the dummy pixel is substantially the same as the structure of a pixel of the pixel array, and the dummy pixel is formed in the display panel 100. As shown in the example of FIG. 9, the dummy pixel is formed in a non-display area DA outside the pixel array AA, on which the input image is displayed, and is covered so that a user cannot see it.

The measurement unit 106 measures a current Imin when a minimum number of switching operations of the pixel through the digital driving method is generated in one frame period, and measures a current Imax when a maximum number of switching operations of the pixel through the digital driving method is generated in one frame period.

The minimum switching current Imin of the pixel may be a current measured when the pixel emits light in only one subframe period of one frame period so that the minimum number of switching operations of the pixel is generated in one frame period. The luminance error resulting from a rush current Ix may be seen as noise. Thus, the minimum switching current Imin of the pixel is a current of the pixel measured when a signal-to-noise ratio (SNR) is large. In an example shown in FIG. 10, the minimum switching current Imin of the pixel was measured when the pixel emits light only in the first subframe SF1 and was maintained in a turn-off state in the remaining subframes.

The maximum switching current Imax of the pixel may be a current measured when the pixel emits light in a plurality of subframe periods so that the maximum number of switching operations of the pixel is generated in one frame period. The maximum switching current Imax of the pixel may be measured when the signal-to-noise ratio is small. However, the maximum switching current Imax of the pixel is measured to reflect a measured value of a real luminance error in a subframe having a relatively short emission time. In the example shown in FIG. 10, when the pixel emits light in a first subframe SF1, is turned off in a second subframe SF2, and emits light in all of subframes SF3, SF4, and SF5 to which an erase period ER is assigned, the maximum number of switching operations of the pixel is generated in one frame period. In this state, the maximum switching current Imax of the pixel is measured.

Figure 10:
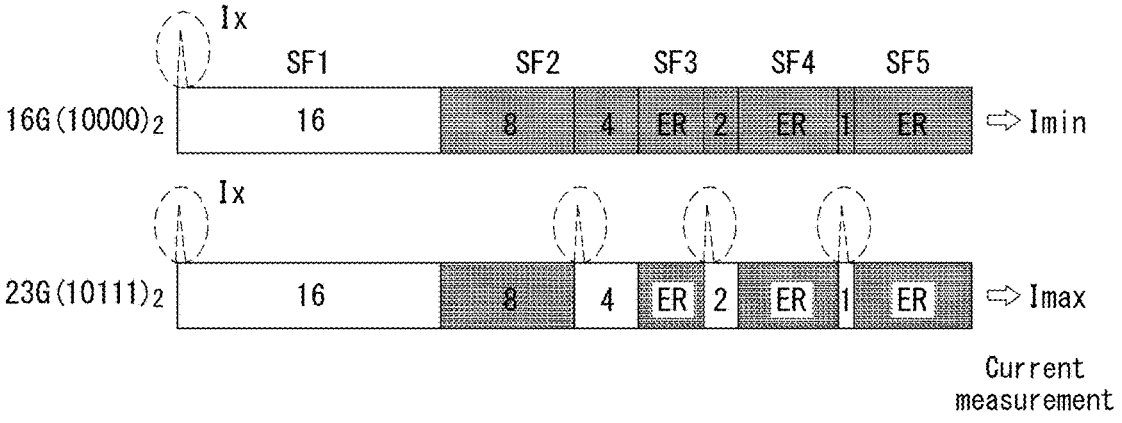
FIG. 10 shows an example of a current measuring method of a pixel and a calculating method of a luminance error.

FIG. 10 shows an example of a current measuring method of the pixel and a calculating method of the luminance error. With reference to FIG. 10, the example luminance error calculation unit 112 calculates an average value Ix_avg of the rush current Ix based on the minimum switching current Imin of the pixel and the maximum switching current Imax of the pixel received from the measurement unit 106.

"Imin" may be a current of the pixel measured at a gray level of $16G(10000)_2$, and "Imax" may be a current of the pixel measured at a gray level of $23G(10111)_2$. A current flowing in the OLED of the pixel at each gray level is previously determined. In this example, it is assumed that the current of the pixel at each gray level is "I_1G=10 nA, I_2G=20 nA, . . . , I_pG=p*10 nA". An example of a method for calculating the average value Ix_avg of the rush current Ix is described below.

$$Imax-Imin=I_7G+(3*Ix) \quad (1)$$

In the above Equation (1), because "I_7G" is a current of 7G (=23G−16G), I_7G is 70 nA. "3*Ix" is a value obtained by subtracting the number of times the rush current occurs at a gray level of $16G(10000)_2$ (e.g., one time) from the number of times the rush current occurs at a gray level of $23G(10111)_2$ (e.g., four times). In the above Equation (1), because Imax, Imin, and I_7G are known values, the rush current Ix may be calculated. The rush current Ix calculated through the above Equation (1) is referred to as "Ix1".

$$Imax+Imin=I_39G+(5*Ix) \quad (2)$$

In the above Equation (2), because "I_39G" is a current of 39G (=23G+16G), I_39G is 390 nA. "5*Ix" is a value obtained by adding the number of times the rush current occurs at a gray level of $23G(10111)_2$ (e.g., four times) to the number of times the rush current occurs at a gray level of $16G(10000)_2$ (e.g., one time). In the above Equation (2), because Imax, Imin, and I_39G are known values, the rush current Ix may be calculated. The rush current Ix calculated through the above Equation (2) is referred to as "Ix2".

The example luminance error calculation unit 112 calculates the average value Ix_avg of the rush current Ix using an average value (=(Ix1+Ix2)/2) of Ix1 and Ix2. The current flowing in the OLED of the pixel is proportional to the luminance of the pixel. Thus, the embodiment of the invention may convert the average value Ix_avg calculated by the luminance error calculation unit 112 into the luminance of the pixel and may quantitatively decide an average value of the luminance error resulting from the rush current Ix based on the average value Ix_avg. Hence, example embodiments of the invention may quantitatively calculate the luminance error resulting from the rush current at each gray level based on the luminance error caused when the rush current Ix is generated once.

The example luminance error compensation unit 114 reflects the luminance error received from the luminance error calculation unit 112 and reduces the emission time of the subframe or performs the remapping of the subframes.

A method for reducing the emission time of the subframe reduces the luminance of the subframe by a luminance increase in the average value Ix_avg. The method fixes an emission time of a MSB subframe having a relatively long emission time and reduces an emission time of an LSB subframe having a relatively short emission time by the luminance increase in the average value Ix_avg.

Figure 11:
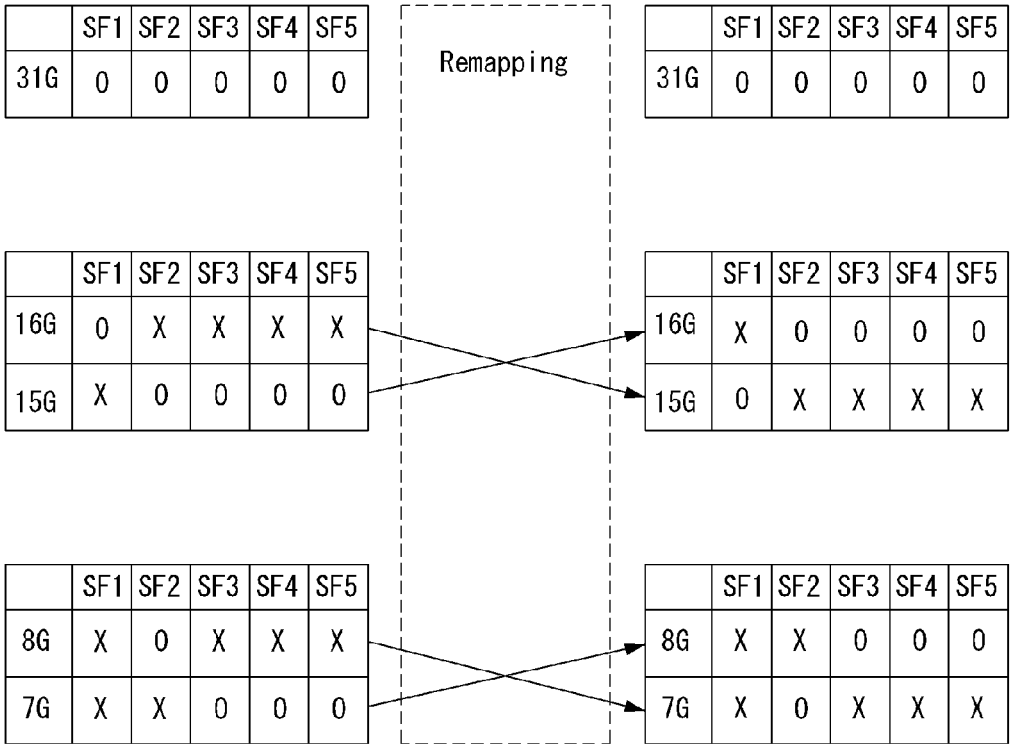
FIG. 11 shows an example of a remapping method of subframes.

The remapping of the subframes changes values of gray levels in which the luminance reversal is generated, and switches between the values of the gray levels of the data at the gray levels in which the luminance reversal is generated. For example, as shown in FIG. 11, when the luminance reversal is generated at gray levels 15G$(01111)_2$ and 16G$(10000)_2$ due to the luminance error, the luminance error compensation unit 114 changes the gray level 16G$(10000)_2$ of data of the input image to 15G$(01111)_2$ and changes the gray level 15G$(01111)_2$ of data of the input image to 16G$(10000)_2$. When the values of the gray levels of the data are changed, there occurs a change in the subframe, which is turned on in the mapping process of the subframes. Therefore, the luminance of the pixel changes. As a result, as shown in FIG. 12, because the emission times of the gray levels in which the luminance reversal is generated, are reversed, the luminance reversal problem may be solved.

Example embodiments of the invention have described a method for measuring the current of the pixel to estimate the luminance error, but embodiments are not limited thereto. For example, embodiments of the invention may measure the luminance of the pixel and may compensate the luminance error of the pixel based on the result of the measurement. Furthermore, example embodiments of the invention described a method for measuring the currents Imin and Imax and calculating the average value of the currents Imin and Imax so as to increase the accuracy of the method for measuring the current of the pixel, but embodiments are not limited thereto. For example, embodiments of the invention may estimate the luminance error of the pixel resulting from the rush current using only the current Imin, even if the accuracy is reduced.

As described above, example embodiments of the invention may compensate for a luminance error resulting from the rush current based on the result of a measurement of the luminance or the current of the pixel of each display panel in the display device driven using the digital driving method. Therefore, embodiments of the invention may adaptively compensate for the luminance error suitably for each display panel.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device for dividing one frame period into a plurality of subframe periods, separating gray level data of an input image on a per bit basis, mapping the gray level data of the input image to the subframe periods, and representing gray levels of the input image by selecting corresponding subframes, the display device comprising:

a current sensor that measures a current of a pixel in the display device;

a luminance error calculation circuit that receives a value of the measured current of the pixel from the current sensor, calculates a rush current of the pixel emitting light at the measured current value, and calculates a luminance error of the pixel based on the rush current, the rush current being a current instantaneously generated when a pixel in an off-state is turned on; and a luminance error compensation circuit that receives the luminance error from the luminance error calculation circuit and, based on the luminance error, reduces an emission time of one of the subframe periods or remaps the subframe periods to compensate for the luminance error, wherein the current sensor measures the current based on the number of switching operations of the pixel generated within one frame period, the switching operation of the pixel corresponding to an operation of converting the pixel from an off-state to an on-state, and wherein the luminance error calculation circuit calculates a value of the rush current based on the number of switching operations.

2. The display device of claim 1, wherein the luminance error compensation circuit reduces an emission time of a subframe period to which a least significant bit (LSB) of data to be written on the pixel will be mapped.

3. The display device of claim 1, wherein the luminance error compensation circuit remaps the subframe periods by switching values of the gray levels of data in which a luminance reversal is generated due to the luminance error of the pixel.

4. The display device of claim 1, wherein the pixel includes an organic light emitting diode.

5. The display device of claim 1, wherein the current sensor measures the current of a dummy pixel located in a non-display area of the display device, wherein the dummy pixel has the same circuit structure as a pixel within the display area of the display device.

6. The display device of claim 1, wherein the measurement, calculation, and compensation of luminance error are performed during a power-on sequence immediately after the display device is powered on, and/or during a power-off sequence immediately after the display device is powered off.

7. The display device of claim 1, wherein the current sensor measures the current, as a minimum switching current, when a minimum number of switching operations of the pixel is generated within one frame period, and wherein the current sensor measures the current, as a maximum switching current, when a maximum number of switching operations of the pixel is generated within one frame period.

8. The display device of claim 7, wherein the luminance error calculation circuit calculates an average value of the rush current based on the minimum switching current and the maximum switching current and calculates the luminance error of the pixel based on the average value of the rush current.

9. The display device of claim 1, further comprising:

a timing controller that controls a data driver and a gate driver and divides one frame period into a plurality of subframe periods.

10. The display device of claim 9, wherein the luminance error calculation circuit and luminance error compensation circuit are embedded in the timing controller.

11. A self-calibration method of a display device for dividing one frame period into a plurality of subframe periods, separating gray level data of an input image on a per bit basis, mapping the gray level data of the input image to the subframe periods, and representing gray levels of the input image by selecting corresponding subframes, the self-calibration method comprising:

measuring a current of a pixel;

calculating a rush current of the pixel emitting light at a value of the measured current of the pixel and calculating a luminance error of the pixel based on the rush current, the rush current being a current instantaneously generated when a pixel in an off-state is turned on; and reducing an emission time of the subframe period or changing the turned-on subframe period to compensate the luminance error of the pixel, wherein the measuring includes measuring the current based on the number of switching operations of the pixel generated within one frame period, the switching operation of the pixel corresponding to an operation of converting the pixel from an off-state to an on-state, and wherein the calculating includes calculating a value of the rush current based on the number of switching operations.

12. The self-calibration method of claim 11, wherein the compensating for the luminance error of the pixel includes reducing an emission time of a subframe period, to which a least significant bit (LSB) of data to be written on the pixel will be mapped.

13. The self-calibration method of claim 11, wherein the compensating for the luminance error of the pixel includes switching between values of the gray levels of data in which a luminance reversal is generated due to the luminance error of the pixel.

14. The self-calibration method of claim 11, wherein the measuring includes measuring the current, as a minimum switching current, when a minimum number of switching operations of the pixel is generated within one frame period, and measuring the current, as a maximum switching current, when a maximum number of switching operations of the pixel is generated within one frame period.

15. The self-calibration method of claim 14, wherein the calculating includes calculating an average value of the rush current based on the minimum switching current and the maximum switching current, and calculating the luminance error of the pixel based on the average value of the rush current.

* * * * *